US005595285A

United States Patent [19]

Do Espirito Santo

[11] Patent Number: 5,595,285

[45] Date of Patent: Jan. 21, 1997

[54] AXIALLY OPERATED SWITCH FOR ELECTRICAL CIRCUITS

[75] Inventor: Antonio F. Do Espirito Santo, Sao Paulo, Brazil

[73] Assignee: Metagal Infudtris E Comercio Ltda., Sao Paulo, Brazil

[21] Appl. No.: 217,674

[22] Filed: Mar. 25, 1994

[51] Int. Cl.[6] ..... H01H 3/20

[52] U.S. Cl. ..... 200/330; 200/341

[58] Field of Search ..... 359/872, 873, 359/874, 875, 876, 877; 200/345, 520, 330, 329, 343, 547, 332, 335, 337, 341, 331, 344

[56] References Cited

U.S. PATENT DOCUMENTS

| | | | |
|---|---|---|---|
| 4,514,603 | 4/1985 | Staples | 200/343 |
| 4,597,681 | 7/1986 | Hodges | 200/345 |
| 4,646,210 | 2/1987 | Skogler et al. | 362/142 |
| 4,877,925 | 10/1989 | Kobayashi | 200/343 |
| 5,117,075 | 5/1992 | Guilleminot | 200/345 |
| 5,280,147 | 1/1994 | Mochizuki et al. | 200/344 |

*Primary Examiner*—David J. Walczak
*Attorney, Agent, or Firm*—Michael J. Striker

[57] ABSTRACT

An axially operated switch for electrical circuits a switch rod having an axis and arranged to move in an axial direction, the switch rod having one end to be actuated and an opposite end arranged to actuate electrical contacts upon its movement in an axial direction, a key arranged to act on the one end of the rod and to move the rod in the axial direction, and a direction changing device cooperating with the key so that the key being pressed by a user is displaced in direction of y axes substantially perpendicular to the axis of the rod and also in direction of x axes substantially parallel to the axis of the rod and as a result acts on the one end of the rod so as to move the rod in the axial direction.

11 Claims, 1 Drawing Sheet

AXIALLY OPERATED SWITCH FOR ELECTRICAL CIRCUITS

BACKGROUND OF THE INVENTION

The present invention relates to an axially operated switch for electrical circuits, which can be used in rearview mirrors or other devices in particular those which do not normally stay in front of operators.

Switches for electrical circuits and in particular axially operated switches or push-button switches are known. In such switches a key is mounted on one end of a rod which extends through a return spring and has an opposite end operating electric contacts located in a box or structure and connected to electrical connection terminals. The operation of such switches is performed by pressing the key in a direction which is coaxial to the rod, forcing the rod to move against the spring to a point in which it changes the state of commutation of the electric contacts. When the key is released the spring pushes the rod and the key to the initial position without changing the reached state of commutation. It is clear that the most favorable position for operation of the switch is when the user's finger is in a coaxial position with respect to the rod. However, in practice this is not always possible. Therefore the mechanical portion of the switch may be submitted to lateral stresses and to undesirable friction and wear.

Many electrical and electronic devices, especially those of the type used in automotive vehicles and provided with push-button switches, such as radio and television sets, turn light control switches, lighting switches and others, are located in front of or sideways of the driver. Therefore they can be operated by the driver without jeopardizing the driving of the vehicle. The key-rod assembly of such switches is generally pressed in a slanted direction in respect to the geometric axis of the rod, submitting it to a lateral stress and as a result to a determinate amount of friction against the sliding seat, which tends to wear to whole assembly during its lifetime. Recognizing the above mentioned problems, the operators of electrical and electronic devices having push-buttons which are to be reached from a lateral position very often and intuitively tend to put their finger in a position which is coaxial with the button before pressing it. This is however undesirable particularly in instruments used in automotive vehicles and operated by drivers, since such a procedure necessarily results in a certain loss of attention by the driver, affecting the safe driving of the vehicle.

SUMMARY OF THE INVENTION

Accordingly, it is an object of the present invention to provide an axially operated switch for electrical circuits, which avoids the disadvantages of the prior art.

In keeping with these objects and with others which will become apparent hereinafter, one feature of the present invention resides, briefly stated, in an axially operated switch of the above mentioned general type which has an axially displaceable switch rod; a key operated by a user and acting on the switch rod; and means for modifying a direction of an operating force applied by the key to the switch rod so that the key moves simultaneously in one direction which is perpendicular to the axial direction of movement of the switch rod and another direction which is parallel to the axial direction of the movement of the switch rod to impart to the switch rod the movement in the axial direction.

When the switch is designed in accordance with the present invention, it eliminates the disadvantages of the prior art. In particular, it allows a convenient operation of the switch, even in cases when the operator's finger touches the key from a slanted position with respect to the switch rod. When the inventive switch is used in an internal rearview mirror with electrical circuit for courtesy light or other circuits, the switch complies with most rigid ergonomical requirements. The inventive axially operated switch used in the electric circuits for example for a courtesy light in internal rearview mirrors, has its key and seat located in a frontal lower edge of a mirror housing and can be reached in a comfortable manner even from a slanted position, since the driver or the front seat passenger are in front and below relative to the mirror. This allows the driver and/or the front seat passenger to operate the switch with an automatic mechanical movement, without paying to much attention to it so as to avoid the loss of attention to the driving of the vehicle.

When the switch is designed in accordance with the present invention, also the lateral stress on the switch rod is minimized or even eliminated. Therefore, excessive frictional wear of the assembly are avoided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
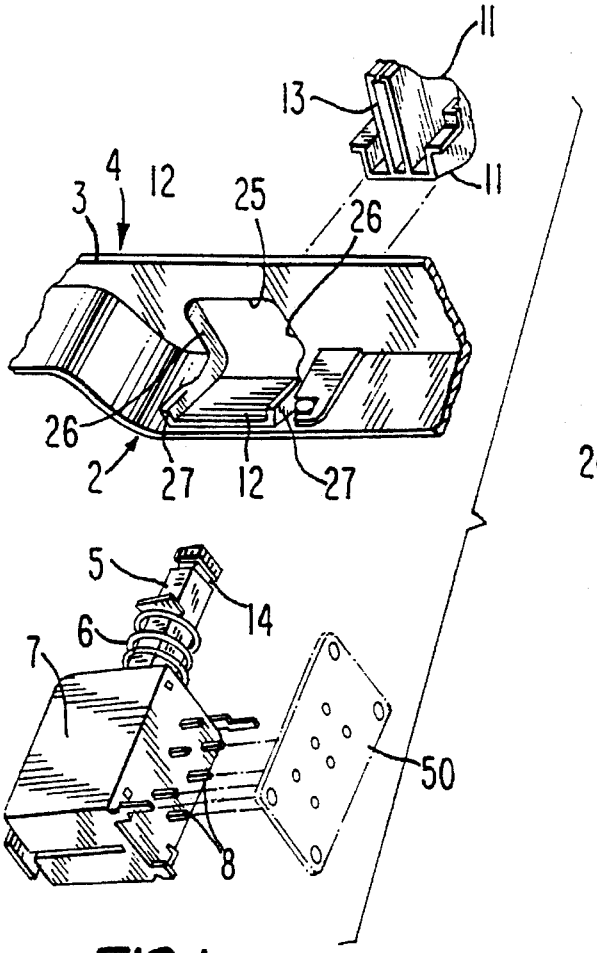
FIG. 1 is an exploded perspective view of an axially operated switch assembly in accordance with the present invention.
Figure 1A:
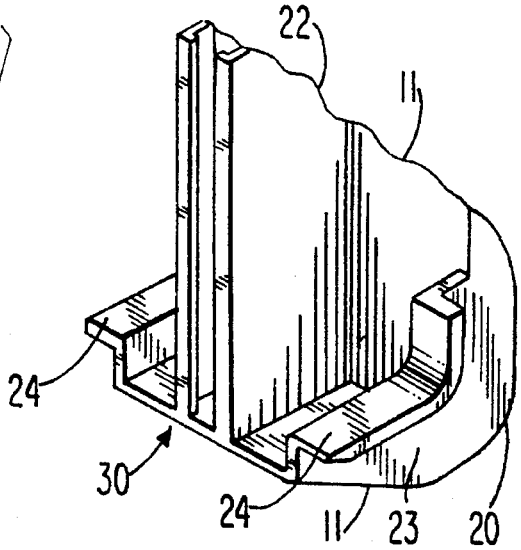

An axially operated switch assembly in accordance with the present invention is formed as a push-button switch and has a key 1 located in a housing 2 of a panel 3. The switch assembly further has a rod 5 with an intermediate region extending through a spring 6 and a sliding seat located in a box 7. The opposite end of the rod 5 activates not shown electric contacts located in the box 7 and connected to electric connection terminals 8.

The switch assembly in accordance with the present invention is provided with a device 10 which changes the direction of force applied by the key 1. The device 10 has guiding means which are identified with reference numerals 11 and 12 and slanted with respect to the rod 5. Also fitting means provide fitting of the key 1 and the rod 5 during operation of the switch assembly. When the key 1 and the rod 5 are connected with one another by the fitting means 13, 14 and a pressure is applied by the user's finger to the key 1, the guiding means 11, 12 provide movement of the key 1 in two directions, namely in a direction y perpendicular to the rod and a direction x parallel to the rod 5 so that as a result the rod 5 performs a straight movement in the direction x along its geometric axis coaxial to its sliding seat in the box 7.

Figure 2:
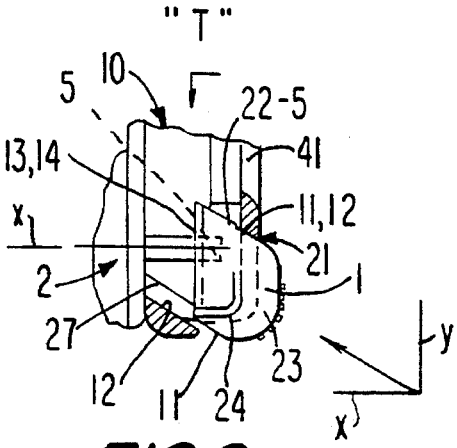
FIG. 2 is a lateral view of an axially operated switch assembly in accordance with the present invention, with a partial section.

As shown in FIGS. 1 and 2, the guiding means include upper and lower surfaces 11 which are provided on the key 1 and slant with respect to a front surface of the key, and upper and lower surfaces 12 provided in a window 21 of the housing 2 and cooperating with the upper and lower surfaces 11 of the key. The upper surface 11 of the key 1 has an intermediate stop 22, while lateral surfaces 23 of the key 1 are provided with shoulders 24 cooperating with respective sides 25 and 26 of the window 21 of the housing 2 to define a stop motion and blocking device for the key 1 in the rest position of the switch assembly. The lower surface 12 of the housing 2 has lateral walls 27 which guide lateral faces 23 of the key 1.

The fitting means include a slide rail 13 provided in a back region 30 of the key 1 and having a T-shaped recess, and a groove 14 provided in an end portion of the rod 5 and engaging in the recess of the slide rail, so that the slide rail 13 can slide in the y direction perpendicular to the rod 5 and at the same time cannot disengage from the rod 5 in the x direction.

Figure 3:
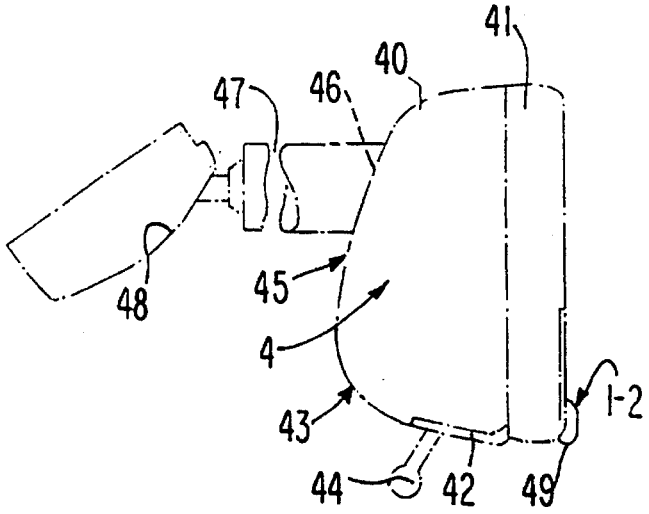
FIG. 3 is a lateral of an internal rearview mirror with an axially operated switch in accordance with the present invention.

A rearview mirror 4 in which the switch of the present invention can be used is shown in FIG. 3. It is provided with courtesy light and formed substantially by a mirror plate with a not shown anti-glare mechanism. The mirror plate is arranged in a front opening and the mechanism is arranged within a housing 40 with a finished molding 41 which surrounds the front opening. A not shown electric circuit for the courtesy lights 42 located in the lower or bottom side 43 of the housing is accommodated in the housing 40. An operating lever 44 of the anti-glare mechanism is movable in a window of the housing, while a supporting arm 47 projects at a rear side 45 of the housing 40 through an opening 46. The free end of the supporting arm 47 is connected to a base 48 which is fixed to a vehicle body or windshield.

The push-button switch assembly 1, 2 is utilized in the internal rearview mirror 4 to control the electric circuit of the courtesy lights 42 and is provided, as explained hereinabove, with the direction changing device 10 including the guiding means 11, 12 and the fitting means 13, 14. When a user presses the key 1, the key performs a movement formed by two direction vectors, in particular a movement in direction of axis y perpendicular to the axial direction of the rod 5 and a movement in direction of axis x parallel to the axial direction of the rod 5, so as to impart a simple straight line movement of the rod 5 in the direction of its geometrical axis. The housing 2 and the key 1 of the inventive switch assembly are located in a front lower edge 49 of the front molding 41 in the mirror housing 40, in order to facilitate the access to the key 1 for an operator located in a normal position relative to the rearview mirror, or in other words below and in front of it. The switch is seated on a printed circuit plate 50 shown in FIG. 1. The printed circuit plate is mounted in the housing 40 and receives electric connections.

It is to be understood that the switch assembly in accordance with the present invention provided with the direction changing device 10 for the forces acting on the switch may be also used in other electrical and electronic instruments of an automotive vehicle, to be operated mainly by the driver and which are not necessarily located in the front of the driver but instead above or below and/or laterally of the driver. For example, the inventive switch can be used for radio, television and tape recorder sets, and panels for turning lights and illumination lights, electrically operated window glass controls, etc. This switch may, of course, be used to command electric-electronic instruments used in other vehicles, such as aquatic, airborne and others, or in other common uses, such as in houses, offices, industries and other places.

It will be understood that each of the elements described above, or two or more together, may also find a useful application in other types of constructions differing from the types described above.

While the invention has been illustrated and described as embodied in a switch assembly, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An axial switch for electrical circuits of a review mirror of a vehicle, comprising a switch rod having an axis and arranged to move in an axial direction, said switch rod having one end to be actuated and an opposite end adopted to actuate electrical contacts upon its movement in an axial direction; a key arranged to act on said one end of said rod and to move said rod in the axial direction; and direction changing means cooperating with said key so that said key being pressed toward said rod by a user is displaced in direction of a y axis which is substantially perpendicular to said axis o said rod and also in direction of an x axis substantially parallel to said axis of said rod without turning and as a result acts on said one end of said rod so as to move said rod in the axial direction.

2. A rearview mirror of a vehicle, comprising a mirror housing having a front opening provided with a finishing molding which has a front lower edge; a mirror plate located in said housing; courtesy lights located in a lower side of said housing and having an electric circuit lodges in said front opening; and an axially operated switch assembly controlling said electric circuit of said courtesy lights, said switch assembly having a switch rod having an axis and arranged to move in an axial direction, said switch rod having one end to be actuated and an opposite end adapted to actuate electrical contacts upon its movement in an axial direction; a key arranged to act on said one end of said rod and to move said rod in the axial direction; and direction changing means cooperating with said key so that said key being pressed toward said rod by a user is displaced in direction of a y axes which is substantially perpendicular to said axis of said rod and also in direction of an x axes substantially parallel to said axis of said rod and as a result acts on said one end of said rod so as to move said rod in the axial direction.

3. A rearview mirror of a vehicle as defined in claim 2, wherein said housing has a window and an opening; and further comprising an anti-glare mechanism operating lever extending through said window of said housing; a supporting arm extending through said opening of said housing and having a free end; and a base connected with said free end of said supporting arm and fixable to a vehicle.

4. An axially operated switch for electrical circuits, comprising a switch rod having an axis and arranged to move in an axial direction, said switch rod having one end to be actuated and an opposite end adapted to actuate electrical contacts upon its movement in an axial direction; a key arranged to act on said one end of said rod and to move said rod in the axial direction; and direction changing means cooperating with said key so that said key being pressed toward said rod by a user is translatorily displaced in direction of a y axes which is substantially perpendicular to said axis of said rod and also in direction of an x axis substantially parallel to said axis of said rod and as a result acts on said one end of said rod so as to move said rod in the axial direction.

5. A rearview mirror of a vehicle, comprising a mirror housing having a front opening provided with a finishing molding which has a front lower edge; a mirror plate located in said housing; courtesy lights located in a lower side of said housing and having an electric circuit lodges in said front opening; and an axially operated switch assembly controlling said electric circuit of said courtesy lights, said switch assembly having a switch rod having an axis and arranged to move in an axial direction, said switch rod having one end to be actuated and an opposite end adapted to actuate electrical contacts upon its movement in an axial direction; a key arranged to act on said one end of said rod and to move said rod in the axial direction; and direction changing means cooperating with said key so that said key being pressed toward said rod by a user is translatorily displaced in direction of a y axes which is substantially perpendicular to said axis of said rod and also in direction of an x axes substantially parallel to said axis of said rod and as a result acts on said one end of said rod so as to move said rod in the axial direction.

6. An axially operated switch for electrical circuits, comprising a switch rod having an axis and arranged to move in an axial direction, said switch rod having one end to be actuated and an opposite end adapted to actuate electrical contacts upon its movement in an axial direction; a key arranged to act on said one end of said rod and to move said rod in the axial direction; direction changing means cooperating with said key so that said key being pressed by a user is translatorily displaced in direction of a y axes which is substantially perpendicular to said axis of said rod and also in direction of an x axis substantially parallel to said axis of said rod and a result acts on said one end of said rod so as to move said rod in the axial direction, said direction changing means including fitting means preventing a disengagement of said key and said rod in said x direction but permitting sliding of said key relative to said rod in said y direction, and guiding means slanted with respect to said rod and extending in the direction of said x and said y axis; and a housing provided with a window in which said key is displaceable, said key having a front surface, said guiding means including an upper surface and a lower surface provided on said key and slanted with respect to said front surface of said key, said guiding means further including an upper surface and a lower surface provided in said window of said housing and being slanted with respect to said front surface of the key so that said upper and lower surfaces of said key slide over said upper and lower surfaces of said window of said housing.

7. An axially operated switch for electrical circuits as defined in claim 6, wherein said upper surface of said key has an intermediate stop, said key having lateral faces provided with shoulders, said window of said housing having sides which together with said intermediate stop and said shoulders define a stop motion and blocking device for said key in a rest position.

8. An axially operated switch for electrical circuits as defined in claim 7, wherein said lower surface of said window of said housing has walls which guide said lateral faces of said key.

9. An axially operated switch for electrical circuits, comprising a switch rod having an axis and arranged to move in an axial direction, said switch rod having one end to be actuated and an opposite end adapted to actuate electrical contacts upon its movement in an axial direction; a key arranged to act on said one end of said rod and to move said rod in the axial direction; and direction changing means cooperating with said key so that said key being pressed by a user is translatorily displaced in direction of a y axes which is substantially perpendicular to said axis of said rod and also in direction of an x axis substantially parallel to said axis of said rod and as a result acts on said one end of said rod so as to move said rod in the axial direction, said direction changing means including fitting means preventing a disengagement of said key and said rod in said x direction but permitting sliding of said key relative to said rod in said y direction, and guiding means slanted with respect to said rod and extending in the direction of said x and said y axis, said key having a back region, said fitting means including a slide rail extending in direction of said y-x axis and having a substantially T-shaped recess, and a groove provided in said one end of said rod and formed so that said slide rail engages in said groove and slides in it in direction of said y axis but cannot disengage from said groove in direction of said x axis.

10. An axial switch for electrical circuits of a rear view mirror of a vehicle, comprising a switch rod having an axis and arranged to move in an axial direction, said switch rod having one end adapted to actuate electrical contacts upon its movements in an axial direction; a key arranged to act on said one end of said rod and to move said rod in the axial direction; and direction changing means cooperating with said key so that said key being pressed by a user is displaced in direction of a y axis which is substantially perpendicular to said axis of said rod and also in direction of an x axis substantially parallel to said axis of said rod and as a result acts on said one end of said rod so as to move said rod in the axial direction, said direction changing means including fitting means preventing a disengagement of said key and said rod in said x direction but permitting siding of said key relative to said rod in said y direction, and guiding means slanted with respect to said rod and extending in the direction of said x axis of said y axis.

11. An axial switch for electrical circuits of a rear view mirror, comprising a switch rod having an axis and arranged to move in an axial direction, said switch rod having one end to be actuated and an opposite end adapted to actuate electrical contacts upon its movement in an axial direction; a key arranged to act on said one end of said rod and to move said rod in the axial direction; and direction changing means cooperating with said key so that said key being pressed toward said rod by a user is displaced in direction of a y axis which is substantially perpendicular to said axis of said rod and also in direction of an x axis substantially parallel to said axis of said rod and as a result acts on said one end of said rod so as to move said rod in the axial direction; and guiding means slanted with respect to said rod and extending in the direction of said x axis and said y axis for guiding said key.

* * * * *